US005337647A

United States Patent [19]

Roberts et al.

[11] Patent Number: 5,337,647

[45] Date of Patent: Aug. 16, 1994

[54] 3 DIMENSIONAL BRAIDING APPARATUS

[75] Inventors: Robert M. Roberts, Elkton, Md.; William A. Douglas, West Grove, Pa.

[73] Assignee: The Boeing Company, Seattle, Wash.

[21] Appl. No.: 850,861

[22] Filed: Mar. 13, 1992

[51] Int. Cl.[5] ..... D04C 3/34

[52] U.S. Cl. ..... 87/31; 87/36; 87/51

[58] Field of Search ..... 87/31, 33, 56, 51

[56] References Cited

U.S. PATENT DOCUMENTS

| | | | |
|---|---|---|---|
| 1,383,522 | 7/1921 | Brown | 87/36 |
| 2,063,734 | 12/1936 | Hale et al. | 139/16 |
| 2,196,900 | 4/1940 | Girard et al. | 87/31 X |
| 2,412,353 | 12/1946 | Parker | 139/104 |
| 3,426,804 | 2/1969 | Bluck | 139/11 |
| 3,459,621 | 8/1969 | Kamenyarzh et al. . | |
| 3,709,969 | 1/1973 | Fairbanks . | |
| 3,714,862 | 2/1973 | Berger | 87/8 |
| 3,719,210 | 3/1973 | Emerson et al. . | |
| 3,719,212 | 3/1973 | Emerson et al. . | |
| 3,834,424 | 9/1974 | Fukuta et al. . | |
| 3,904,464 | 9/1975 | King . | |
| 3,993,817 | 11/1976 | Schultz . | |
| 4,059,468 | 11/1977 | Bouillon . | |
| 4,063,684 | 12/1977 | O'Brien et al. . | |
| 4,123,832 | 11/1978 | Schultz . | |
| 4,183,232 | 1/1980 | Banos et al. . | |
| 4,201,611 | 5/1980 | Stover . | |
| 4,209,560 | 6/1980 | Vasilos . | |
| 4,257,835 | 3/1981 | Bompard . | |
| 4,312,261 | 1/1982 | Florentine | 87/33 |
| 4,336,296 | 6/1982 | Fukuta et al. . | |
| 4,346,741 | 8/1982 | Banos et al. . | |
| 4,369,554 | 1/1983 | Curinier et al. . | |
| 4,379,798 | 4/1983 | Palmer et al. . | |
| 4,389,447 | 6/1983 | Disselbeck et al. . | |
| 4,407,885 | 10/1983 | Murphy et al. . | |
| 4,416,929 | 11/1983 | Krueger . | |
| 4,448,624 | 5/1984 | Webber . | |
| 4,476,206 | 10/1984 | Viala et al. . | |
| 4,491,617 | 1/1985 | O'Conner et al. . | |
| 4,512,836 | 4/1985 | Tucci . | |
| 4,519,290 | 5/1985 | Inman et al. . | |
| 4,539,254 | 9/1985 | O'Connor et al. . | |
| 4,556,440 | 12/1985 | Krueger . | |
| 4,574,029 | 3/1986 | Murray . | |
| 4,614,147 | 9/1986 | Vendramini . | |
| 4,621,560 | 11/1986 | Brown et al. | 87/33 X |
| 4,624,726 | 11/1986 | Harper, Jr. . | |
| 4,628,681 | 12/1986 | Vanderpyl et al. . | |
| 4,631,931 | 12/1986 | Banos . | |
| 4,719,837 | 1/1988 | McConnell | 87/1 |
| 4,881,444 | 11/1989 | Krauland | 87/33 X |
| 4,898,067 | 2/1990 | Ashton et al. | 87/36 X |
| 4,922,798 | 5/1990 | Ivsan et al. | 87/33 X |
| 4,936,186 | 6/1990 | Sekido et al. | 87/33 X |
| 4,984,502 | 1/1991 | Spain et al. | 87/33 X |

FOREIGN PATENT DOCUMENTS

| | | |
|---|---|---|
| 724604 | 2/1955 | United Kingdom . |
| 1388843 | 3/1975 | United Kingdom . |

*Primary Examiner*—Joseph J. Hail, III
*Attorney, Agent, or Firm*—Jones, Tullar & Cooper

[57] ABSTRACT

An apparatus for braiding a three dimensional form from individual fibers. The fiber is supplied on a plurality of fiber carriers situated in slots in track members forming a carrier plane at the base of the machine. The carriers are moved in a linear manner with the tracks and are also moved transverse to the track in columns formed by the slots in the tracks. Automatic elements are provided to limit the travel of the tracks and the columns to one, two or three discreet steps and to return the tracks and carriers to their original positions at the end of a braiding cycle. Automatic elements are provided to take up the braided form as it is fabricated. Elements are also provided for compacting the braided form periodically during the braiding process.

19 Claims, 19 Drawing Sheets

32
194
66
86
88
90
60
90
81
80
75
77
74

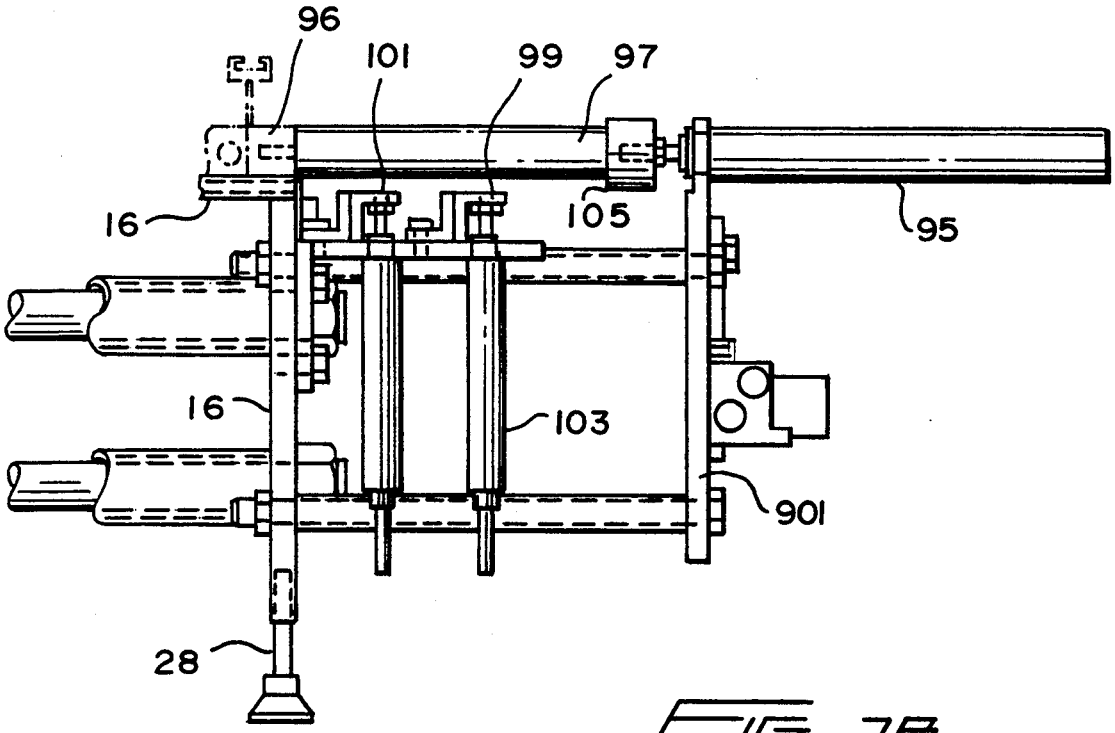
FIG. 7B
FIG. 7C
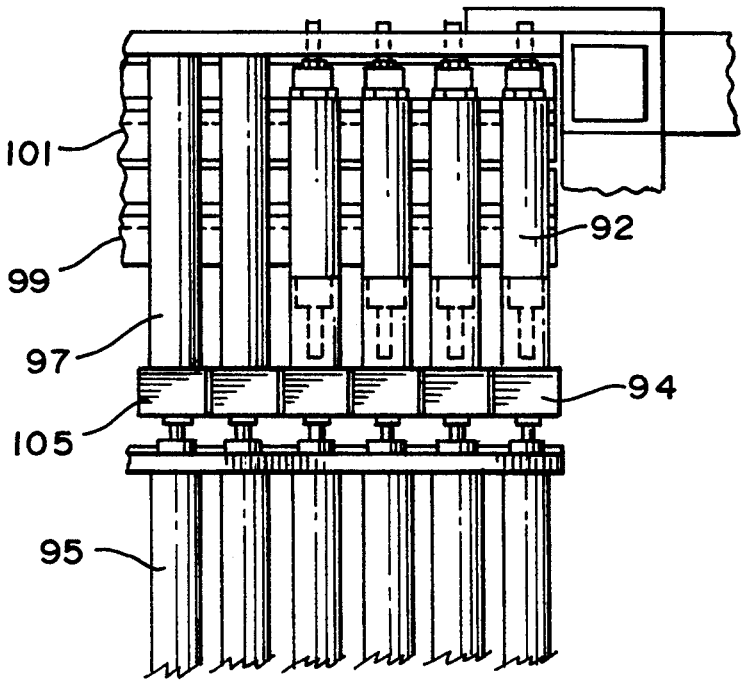

3 DIMENSIONAL BRAIDING APPARATUS

BACKGROUND OF THE INVENTION

Reinforced composite structures have been developed consisting of single or multiple kinds of fibers placed in unidirectional layers or at varying angles or combinations thereof to form a fiber matrix. The matrix is then impregnated with a resin and cured to form a composite structural shape. While these structures are strong "in-plane" that is, in the plane of the fiber layers, they are relatively weak in the vertical direction transverse to the plane of the fiber layers. In this direction there is no mechanical bond between the fibers. The only bond is that formed by the resin impregnation. The most common failure of these structures is delamination of the fiber layers in the vertical direction. Since these structures are often used in aircraft and spacecraft where high strength and low weight construction elements are necessary, such a delamination failure can be catastrophic.

Systems have been devised to form multi fiber composite structures in a three dimensional braided configuration. That is, in addition to the traditional two dimensional layers, the fibers are mechanically interwoven in a three dimensional matrix in the desired cross sectional form. Shapes such as I, H, and L forms can be fabricated as well as other shapes where desired.

While all of the prior art devices are able to produce the desired shapes, the braiding mechanisms are limited in flexibility, complicated and operate at slow speed with many steps in the process being performed manually. Also such machines are not capable of producing large structures required for fabrication of aircraft or spacecraft. Typical of the present machines are those described in U.S. Pat. No. 4,312,261 to Florentine and U.S. Pat. No. 4,719,837 to McKonnell.

In machines of this type to which this invention relates, a horizontal frame forming a carrier plane is provided which is divided in to multiple rows and columns in a rectangular matrix. Carrier members, each holding a supply of fiber on a spool or similar device, are inserted in the rows and columns such that they may be moved in predetermined rectilinear patterns over the carrier plane to form the desired braided form at a fabrication frame situated above the carrier plane. Periodically, the braiding process must be halted in order to compact the braided form. This step is referred to as "beating" and is analogous to the beating step of a conventional fabric loom when weaving two dimensional fabrics.

As the braided form is fabricated, a take-up mechanism above the fabrication plane pulls the completed preform out the top of the machine. As previously described, in the present braiding machines, flexibility of the process has been limited and mechanization has been minimal with many steps being manually performed. In order for three dimensional braided forms to be economically feasible for use in industry, the braiding process must be mechanized to provide for rapid, automated fabrication of composite three dimensional pre-forms.

SUMMARY OF THE INVENTION

A machine for fabrication of three dimensional braided preforms is described which automatically executes the many steps required for fabricating such structures, eliminating all manual steps except for resupplying fiber to the carrier members. This machine allows the manufacture of various designs of preforms by providing for movement of each carrier 1, 2, or 3 rows or columns at each carrier move or "shuffle". Since the individual fibers must enter the fabrication plane at an angle of no more than approximately 22½ degrees from the plane vertical to the carrier plane, means are provided for maintaining this angle throughout the braiding process. Automated beating of the braided structure is provided in two axes which provides for variable compaction patterns.

During the beating cycle the primary means for maintaining the 22½ degree angle at the fabrication plane must be momentarily removed to allow compaction of the braided preform through the fabrication plane. Means are provided for temporarily removing the primary angular restraint means during beating while maintaining the 22½ degree angle through a second mechanism. Additionally, mechanical means are provided to insure that the beating element travels in a path parallel to the angularly placed braiding fibers through linear interpolation.

As the preform fabrication progresses, an automatic take-up mechanism is actuated to pull the completed preform up from the fabrication plane. When the take-up reaches its limit of travel a second mechanism grasps the preform and allows the take-up mechanism to travel to its original starting position and re-grip the braided form, thus allowing the production of preforms of substantial length.

BRIEF DESCRIPTION OF THE DRAWINGS

FIGS. 7B and 7C are details of the track stop mechanism of FIG. 7A.

DETAILED DESCRIPTION OF THE PREFERRED EMBODIMENT

Figure 1:
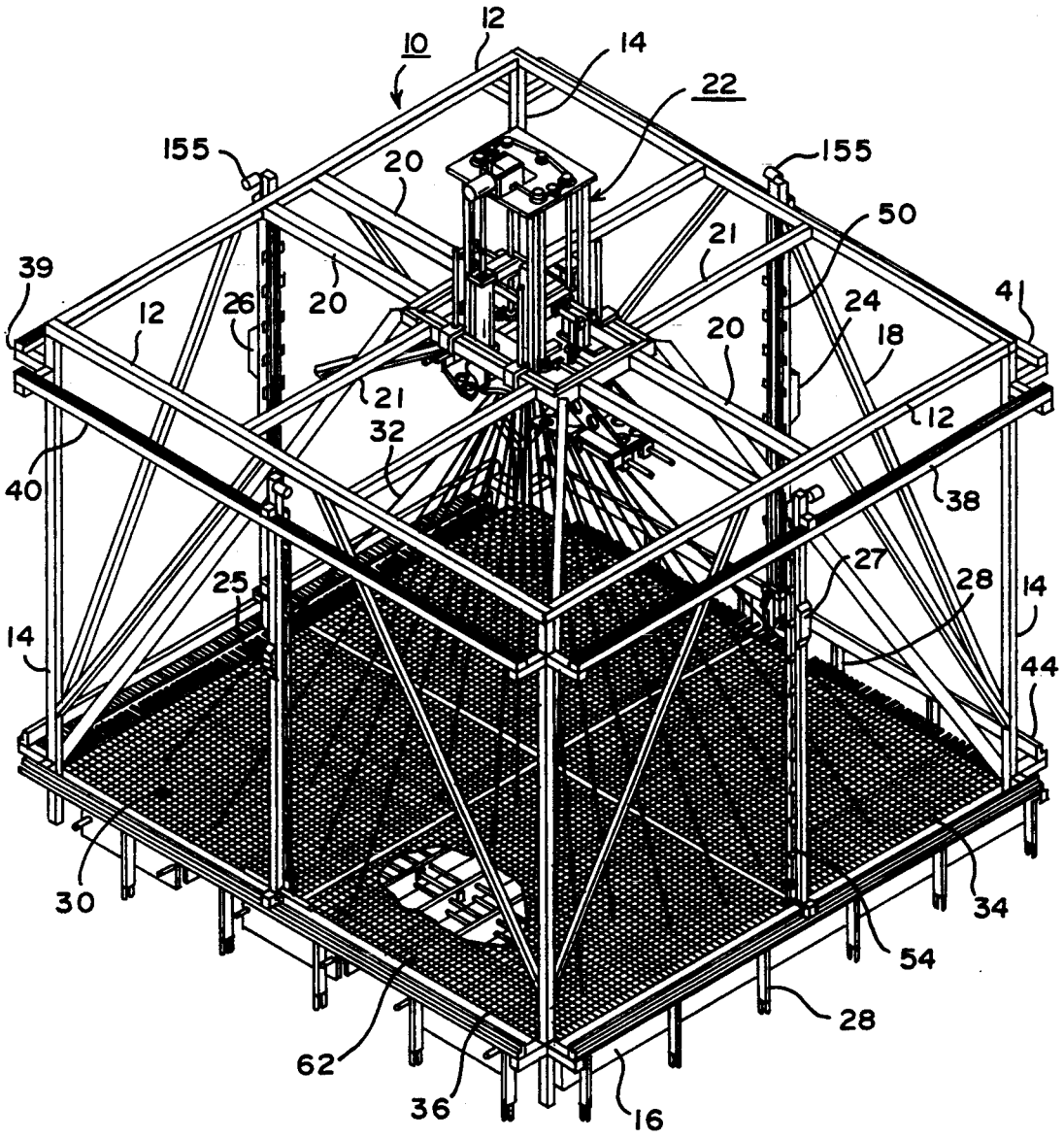
FIG. 1 is an isometric view of the braiding machine assembly.

Referring now to FIG. 1, there is generally shown at 10 an isometric view of the assembled three dimensional braiding machine. A machine frame is formed by four upper frame members 12 forming a generally rectangular shape. The upper frame members 12 are supported by corner members 14 which are connected to lower frame members 16. The frame assembly is further strengthened by the use of diagonal braces 18 on all four sides. Attached to the upper frame members 12 are two sets of cross members 20 and 21. These cross members support the fabrication and take-up mechanism shown generally at 22. This mechanism is described in greater detail in connection with the discussion of FIGS. 8–11 below.

The lower frame members 16 form a support for the carrier plane shown generally at 30. In the preferred embodiment, this carrier plane is composed of 132 rows of assembled tracks 34 which are discussed in more detail in connection with FIGS. 2–6. Each row of track contains 90 individual pockets 62 along its length. In the embodiment described, this assembly thus provides a total of 11,700 pockets to perform the braiding process. Certain selected pockets will contain fiber carriers as is discussed in regard to FIGS. 2–6 and 15. The fiber from the carrier is fed from the carrier plane 30 to the fabrication head 22. A typical fiber is shown at 32. In the center of each vertical side of the frame the mechanisms for beating the braided preform are assembled. The beating mechanisms are arranged in pairs of assemblies placed on opposite sides of the frame.

Figure 12:
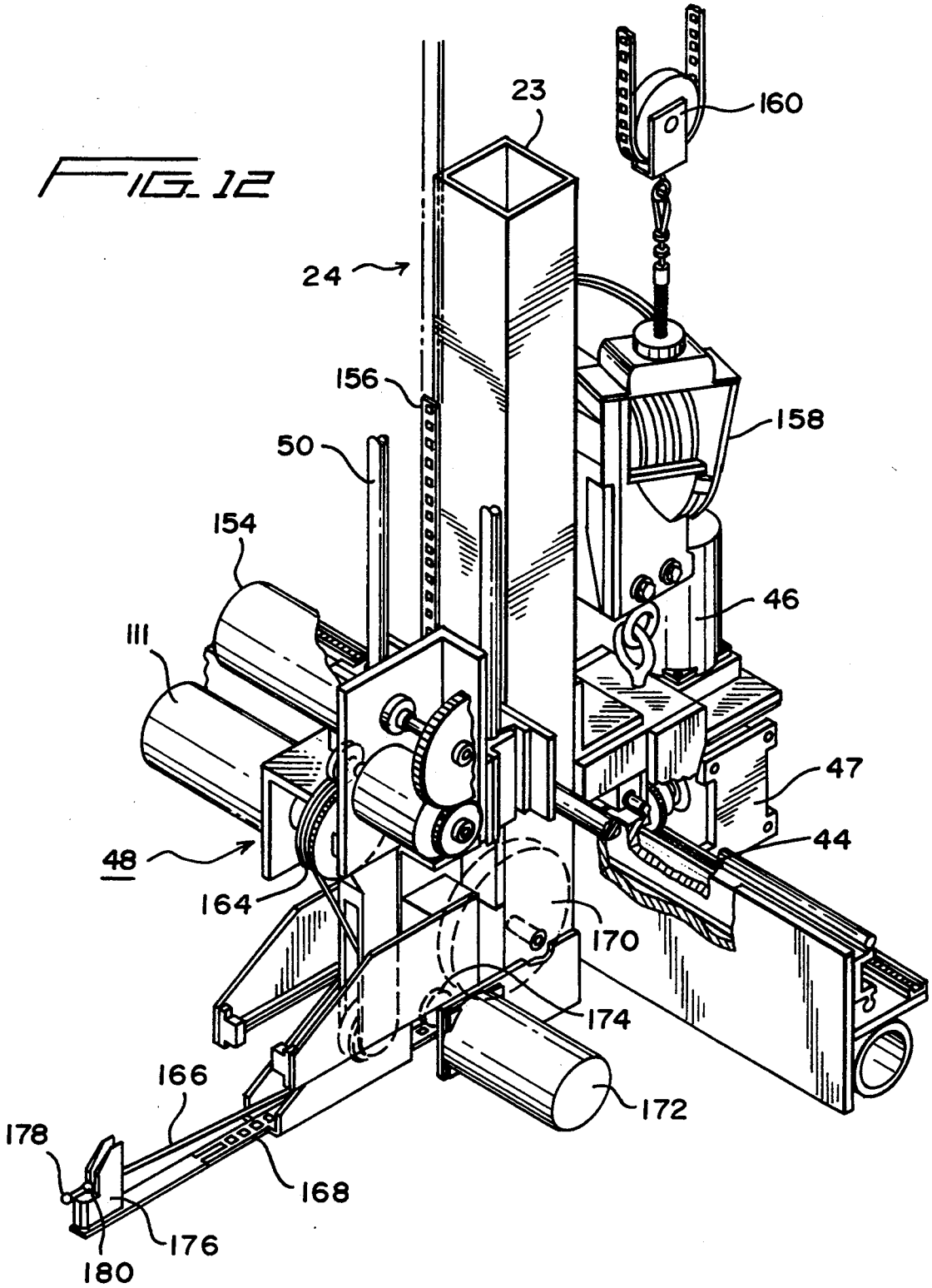
FIG. 12 is an isometric view of the beater transport mechanism.

Each pair consists of a sender station and a receiving station. At the sides of the frame subtending the rows 34 are a sending station 27 and a receiving station 26. Along the sides of the frame subtending the columns 36 are a sending station 24 and a receiving station 25. The four beating stations are mounted on horizontal tracks for movement along the frame. The sending station 24 is supported on upper track 41 and lower track 44. The lower track assembly is supported by a plurality of legs 28. Each of the beating stations is likewise supported on an upper and lower track in the same manner. A servo motor 46 and speed reducer 47 shown in FIG. 12, are attached to the bottom of station 24 for moving the stations laterally. Each station is provided with such a motor and speed reducer in a similar manner. Each sending station contains a vertical track 50 upon which is mounted a beater sending assembly 48 which is discussed in detail in connection with FIGS. 12 and 13. On the opposite receiving station, a beater receiving assembly 25 is attached to a vertical track 54 for vertical movement along this track. The receiving assembly is discussed in more detail in connection with FIG. 14.

Figure 2A:
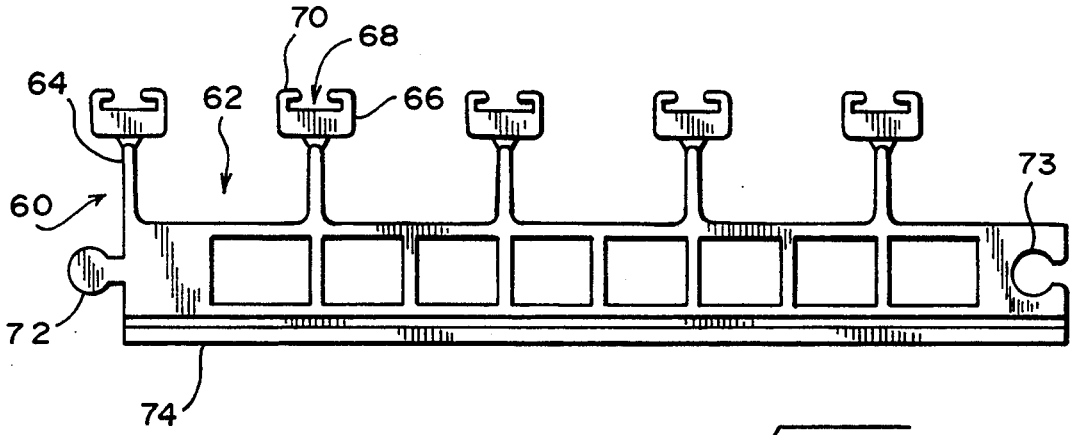
FIGS. 2A and 2B are elevation views of a carrier track section.
Figure 2B:
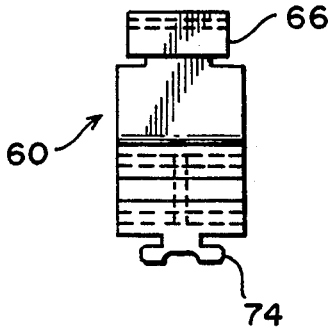
Figure 3A:
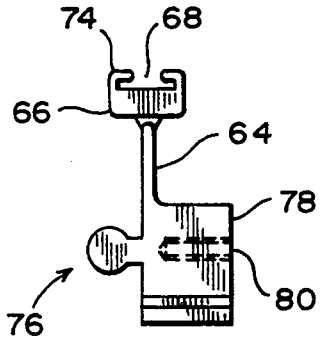
FIGS. 3A and 3B are elevation views of a modified rack end piece.
Figure 3B:
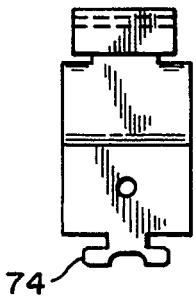
Figure 6A:
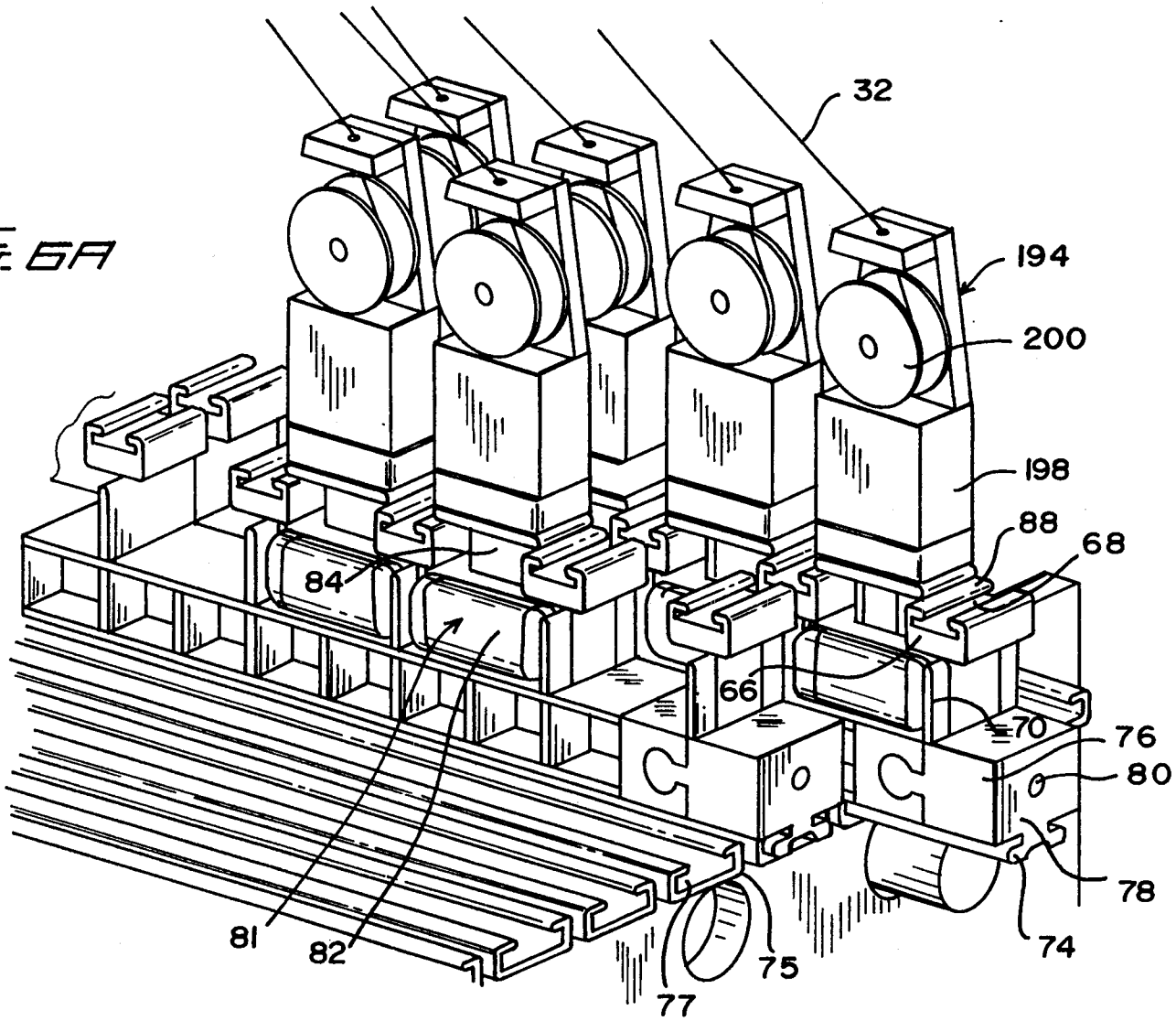
FIG. 6A is an isometric view of a carrier track section, carrier base and carrier piece assembly.
Figure 6B:
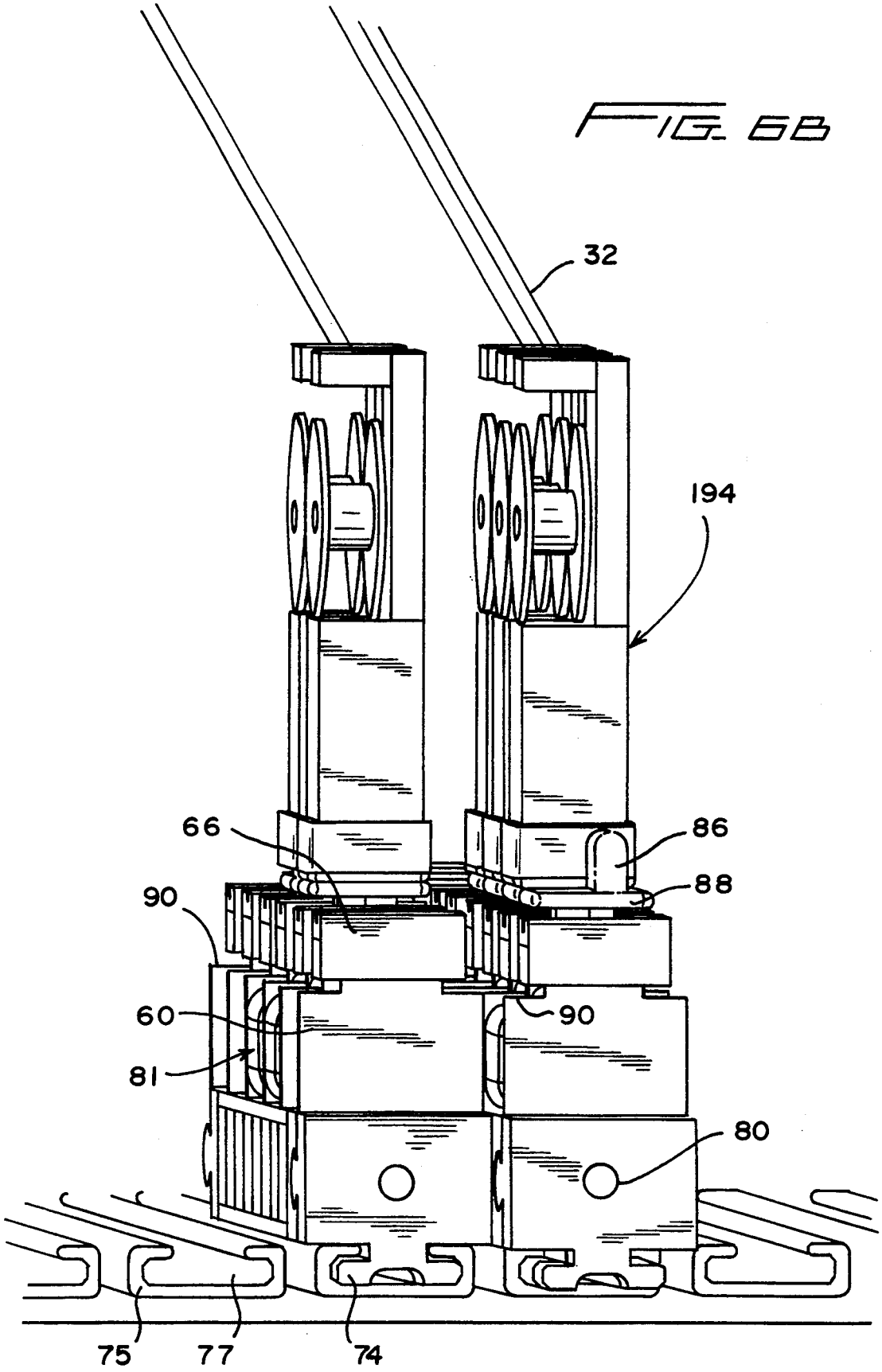
FIG. 6B is an isometric end view of a carrier track, carrier base and carrier piece assembly.

Referring now to FIGS. 2A and 2B, there is shown at 60 a typical section of track. Each track section comprises four pockets 62 separated by a web member 64. At the top of each web member 64 is a slot member 66 which contains a slot 68 partially enclosed by lips 70. The function of these slots will be discussed in the operation of one of the two pairs of beating mechanisms. At one end of the track section 60 is a male connector piece 72 and at the other end a female connector slot 73. The track sections are connected end to end by mating these connected members to form a track assembly 63. Once connected, a fifth pocket is created. Each track section is provided with an insertion foot 74 which fits a mating slot 77 in the frame as shown in FIG. 6B. As shown in FIGS. 6A and 6B, track support members 75 extend across the lower frame to support the track members 60 for sliding motion along the track support slot 77. At one end of the track assembly, a track end piece 76 shown in FIGS. 3A and 3B is provided which also has a male connector piece 72 at one end but at its distal end there is provided a flat surface 78 containing a threaded hole 80 for attachment to the carrier actuator discussed in connection with FIG. 7.

Figure 4A:
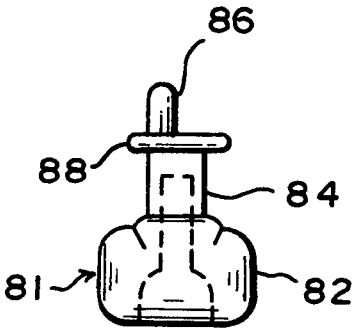
FIGS. 4A and 4B are elevation views of a carrier base member.
Figure 4B:
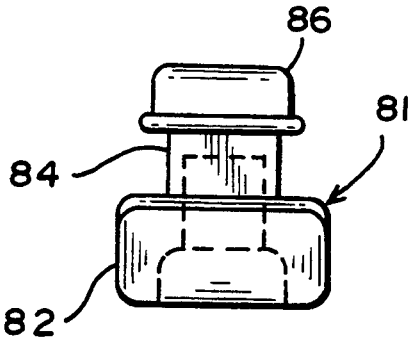
Figure 5A:
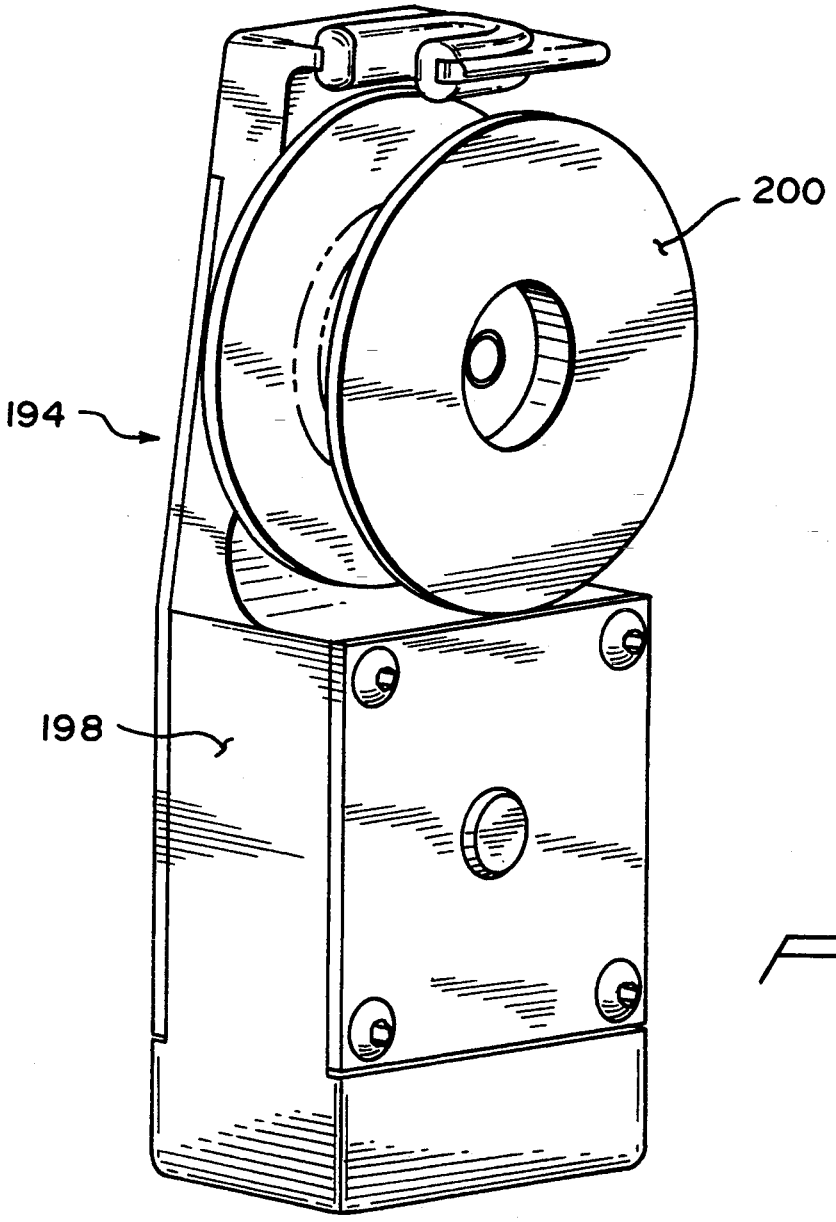
FIG. 5A is an isometric view of a carrier (fiber supply bobbin) piece.
Figure 5B:
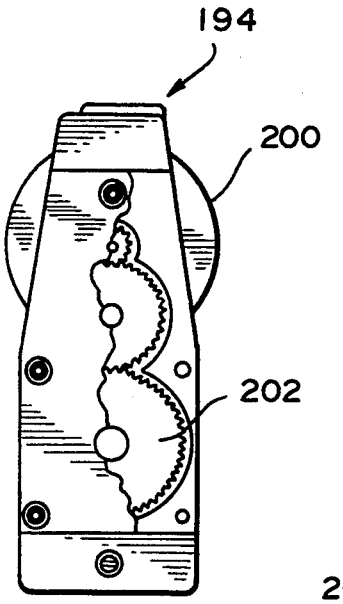
FIGS. 5B, 5C and 5D are three views of the carrier piece.
Figure 5C:
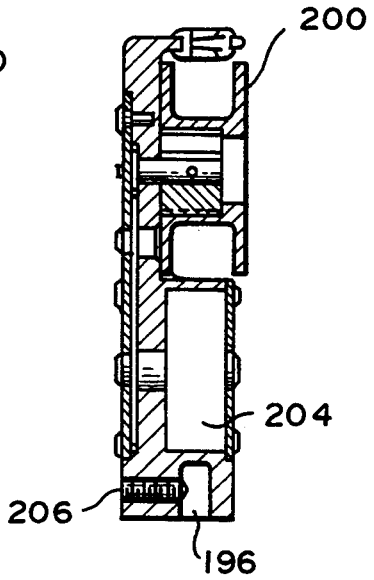
Figure 5D:
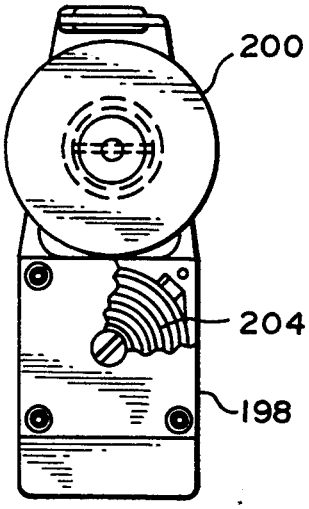

Referring now to FIGS. 4A and 4B, there are shown two views of the carrier base 81 which has a large base member 82 adapted to be in sliding engagement in the pocket 62 of the track member 60. Extending upward from the base 82 is a web portion 84 which is topped by a flange 88 and an upper carrier attachment member 86.

When the apparatus is prepared for braiding, a plurality of fiber supply bobbins are attached to the carrier bases 80. Supply bobbins 194 are shown in detail in FIGS. 5B, 5C and 5D. The reel has a base member 198 having a slot opening 196 in its base. This slot receives carrier attachment member 86 which projects from the body of a carrier base 80. A ball plunger 206 is provided to attach the bobbin to the carrier base.

A reel 200 holds a supply of fiber to be braided. The reel 200 is attached to a tensioning spring 204 and to a gear train 202. The tension spring maintains its constant, preset tension on the fiber during the braiding operation. These supply bobbins are commercially available, for example, from A. B. Carter Inc.

In FIG. 6A, a portion of the track 60 is shown with the carrier base members and carriers of FIG. 5 installed. Referring now to FIG. 6B, there is shown an endwise perspective view of the assembly of FIG. 6A rotated to show the slot 90 formed by the assembly of the tracks 60. This slot performs the same function as slot 68 in the track section 60 for the other pair of beating mechanisms which are used in the beating process described in detail in reference to FIGS. 12, 13 and 14.

Figure 7A:
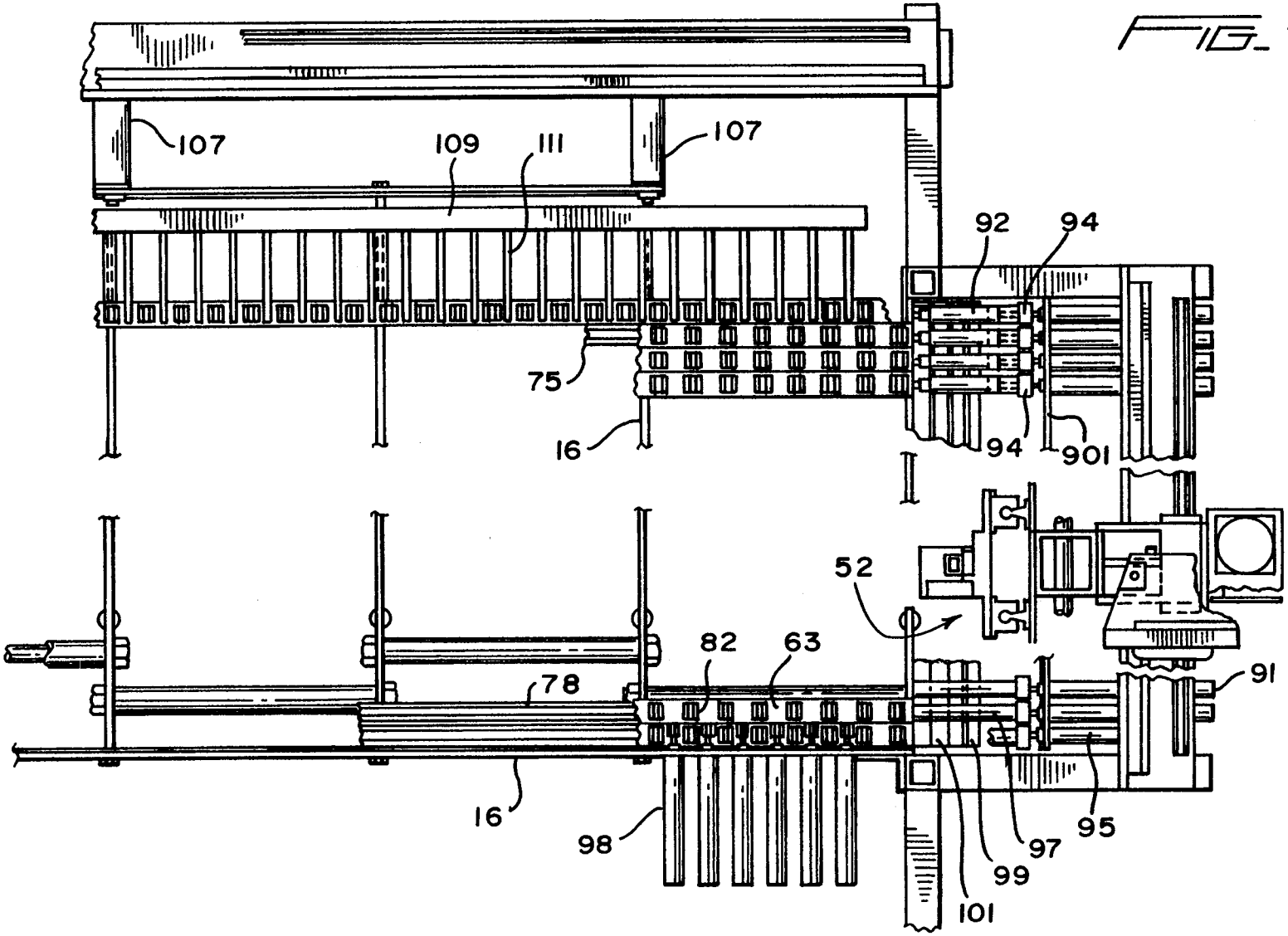
FIGS. 7A is a partial plan view of the carrier plane assembly.

Referring now to FIGS. 7A and 7B, there is shown in greater detail the assembly of the carrier plane 30. There is shown a portion of the track support 75 assembled into the lower frame 16. Attached to lower frame 16 are four mounting frame members 901. Attached to the frame members 901 are a series of actuators 95 which are each attached to a track assembly 63 via end piece 76 by means of a cylinder rod extension 97 shown in FIG. 7B. These actuators move their respective tracks in response to command signals from the controller as described below. Each actuator is allowed to move its track zero, one, two or three spaces depending on the particular braiding process being used. If required, the maximum number of spaces moved could be increased by expanded selected components. To select the number of spaces a specified track is to move, the stop mechanisms shown in FIGS. 7C and & 7D are used. Stopper bars 99 and 101 are provided running along one side of the frame. The stoppers 99 and 101 are connected to a series of actuators 103 spaced along their length. If the track is to be moved three spaces, the stoppers are maintained in their lowered position and the actuator 95 moves its total stroke length for a total of three spaces on the carrier plane. When a track is to be moved two spaces, stopper 101 is raised by its actuators to cause the shoulder 105 of the actuator extension 97 to contact the raised stopper 101 after a stroke length equal to two spaces on the carrier plane. When a track is to be moved one space, stopper bar 99 is raised and shoulder 105 of the actuator extension contacts the raised stopper. Also attached to the actuators 95 are a series of shorter rod extensions 94. Attached to these rod extensions 94 are secondary track actuators 92 which are attached to the four track assemblies 63 at one side of the frame. The rod extension 94 and actuator 92 may move zero, one, two or three steps to move its track assembly as described above. The secondary actuator 92 can move the track assembly one half of a complete step. This one half step movement of a track blocks pocket 62 in the adjacent track to impede motion of the carrier base 82 in the pocket as required by the particular braiding process being used. This function will be described in more detail in connection with the detailed description of the operation of the device.

At one adjacent side of the lower frame 16 is a second set of actuators 98, shown in FIG. 7A acting along the columns of pockets 62 formed by the assembly of track sections 60. Each of these actuators may move zero, one, two or three steps according to the braiding process selected. When an actuator is moved it contacts the first carrier base 82 and moves the entire string of carrier bases along the column of pockets as commanded. If any of the secondary track actuators 92 has been moved one half step, carrier bases moved by the column actuator will be stopped at the track which was moved one half step. Thus, if the carrier bases in a column are not to be moved in a "shuffle", the first half step actuator at the free end of a column (opposite the column actuator) is energized blocking all columns. Thus, when the first half step actuator is energized, the columns of carrier bases actuated are not allowed to move when the actuators 98 are energized. If the carrier bases are to be moved one space, the second half step actuator from the free end of the column is actuated and the chosen actuators 98 and, as a result, the carrier bases are allowed to move one space. Likewise, when the carriers are to move two spaces, the half space actuators third from the free end of the column actuators is energized thus allowing the carrier bases and carriers to move two spaces. The process is the same when a three space carrier move is desired.

Extending along the side of the frame opposite the column actuators is a reset mechanism for returning the carrier bases to their original starting positions at the end of a "shuffle". This reset mechanism consists of a comb bar 109 which carries a series of reset teeth 111. Each reset tooth is aligned with a column of carrier bases. The movement of the reset bar is controlled by a series of actuators 107 spaced along the bar 109. At the end of a "shuffle" the actuators 107 are energized and the comb teeth move the carrier bases back to their original starting position.

Figure 8:
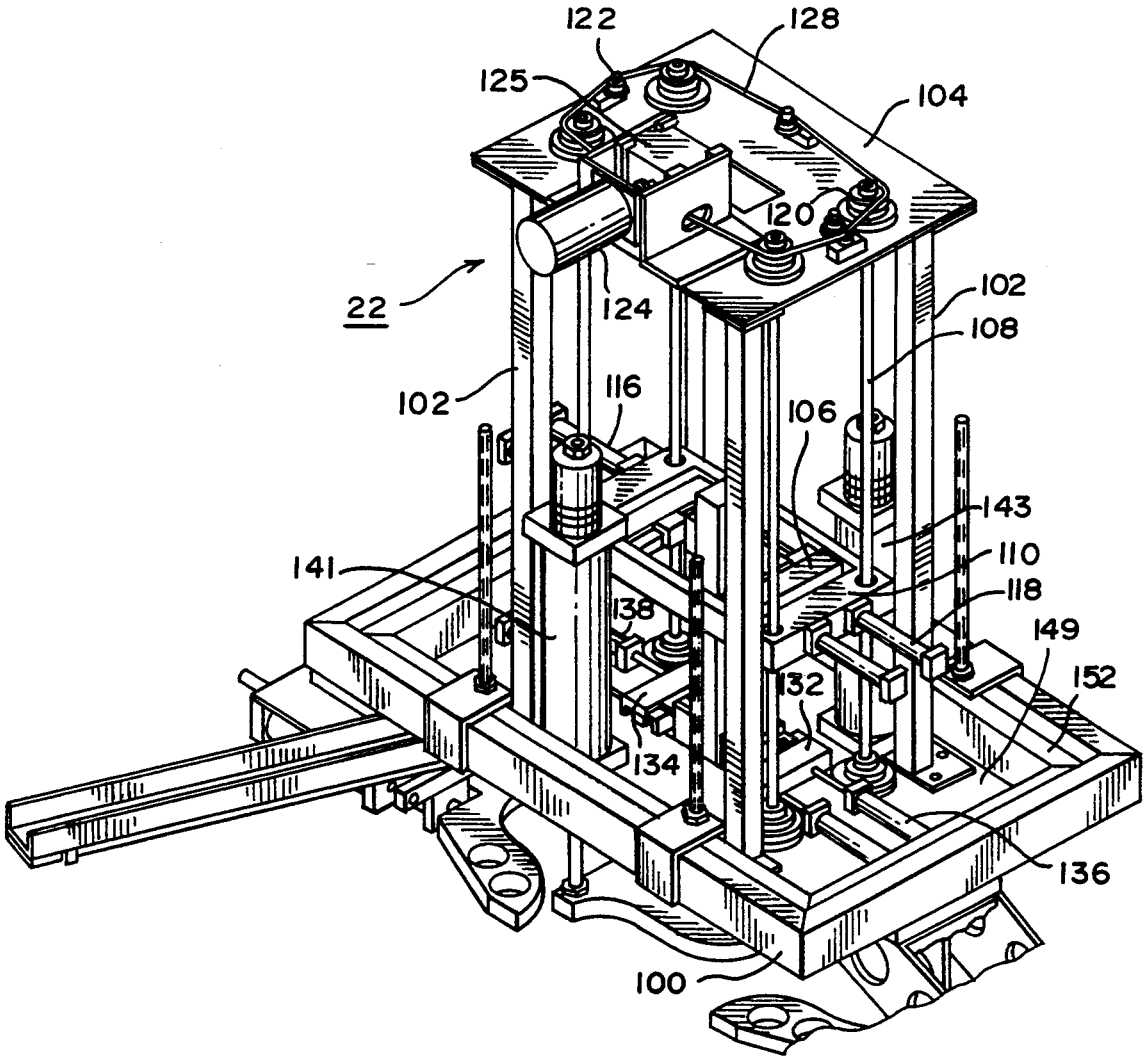
FIG. 8 is an isometric view of the take-up mechanism assembly.
Figure 9A:
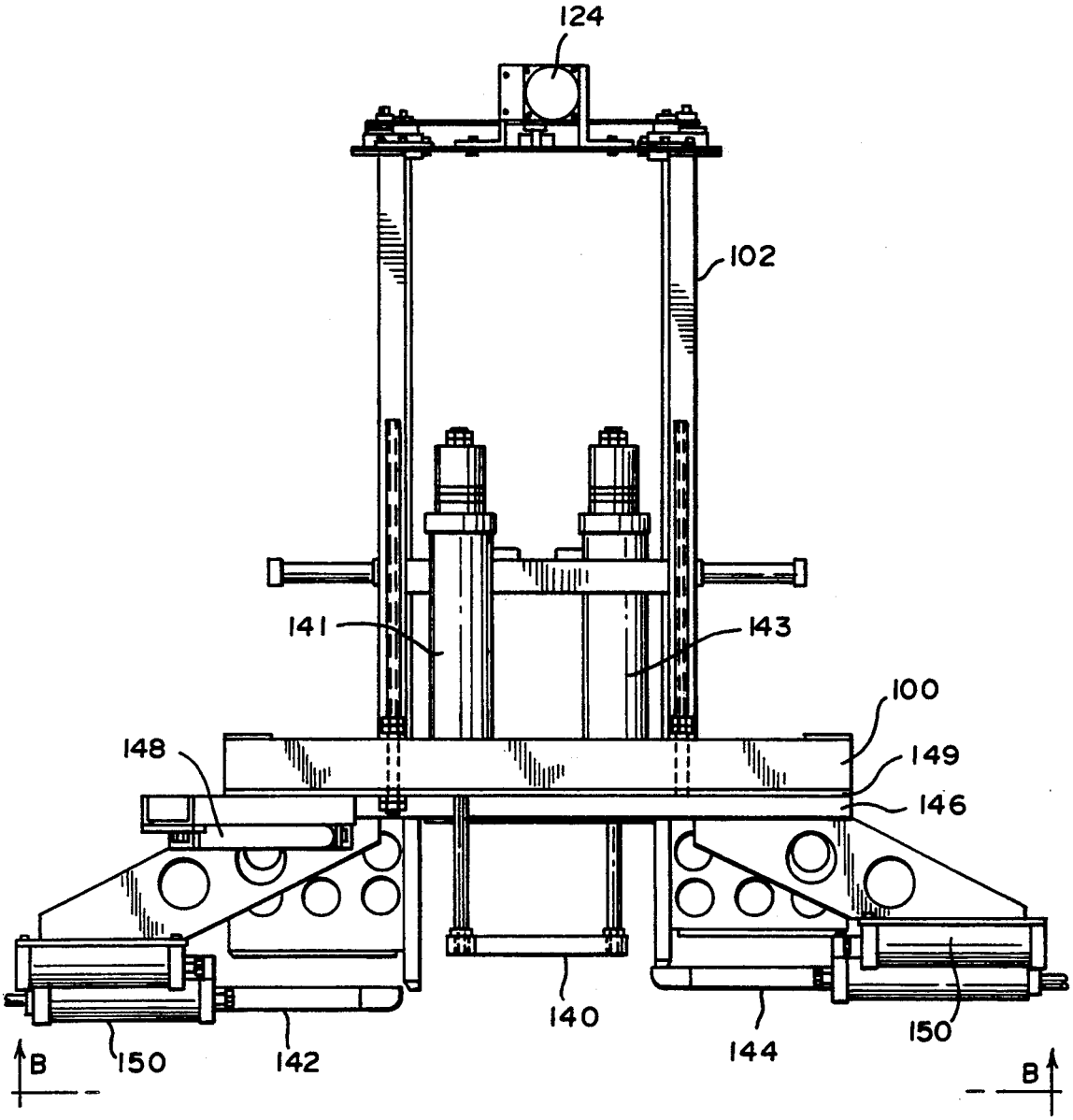
FIGS. 9A is an elevation view of the take-up mechanism assembly
Figure 9B:
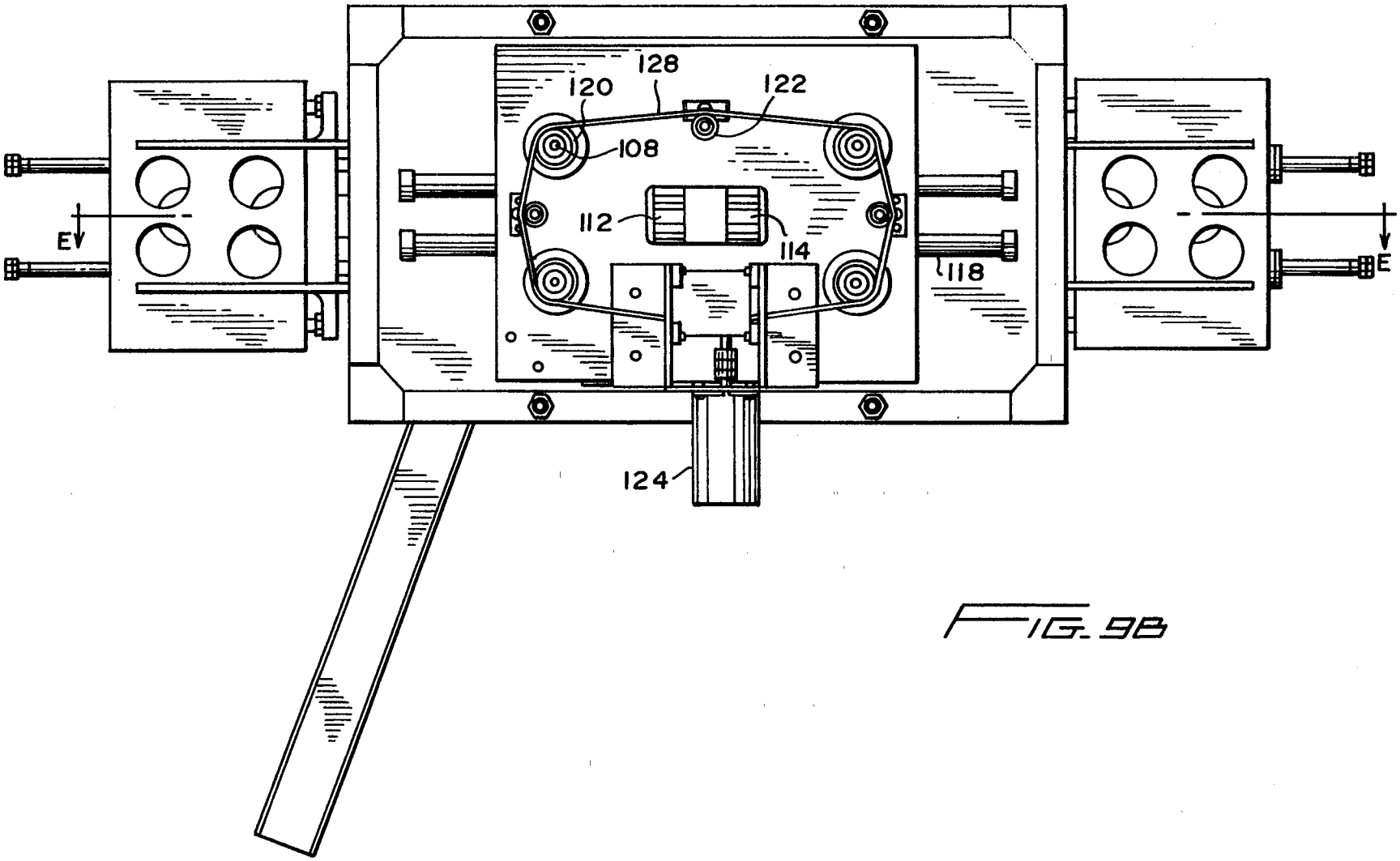
FIG. 9B is a top plan view of the take-up mechanism of FIG. 9A.
Figure 10:
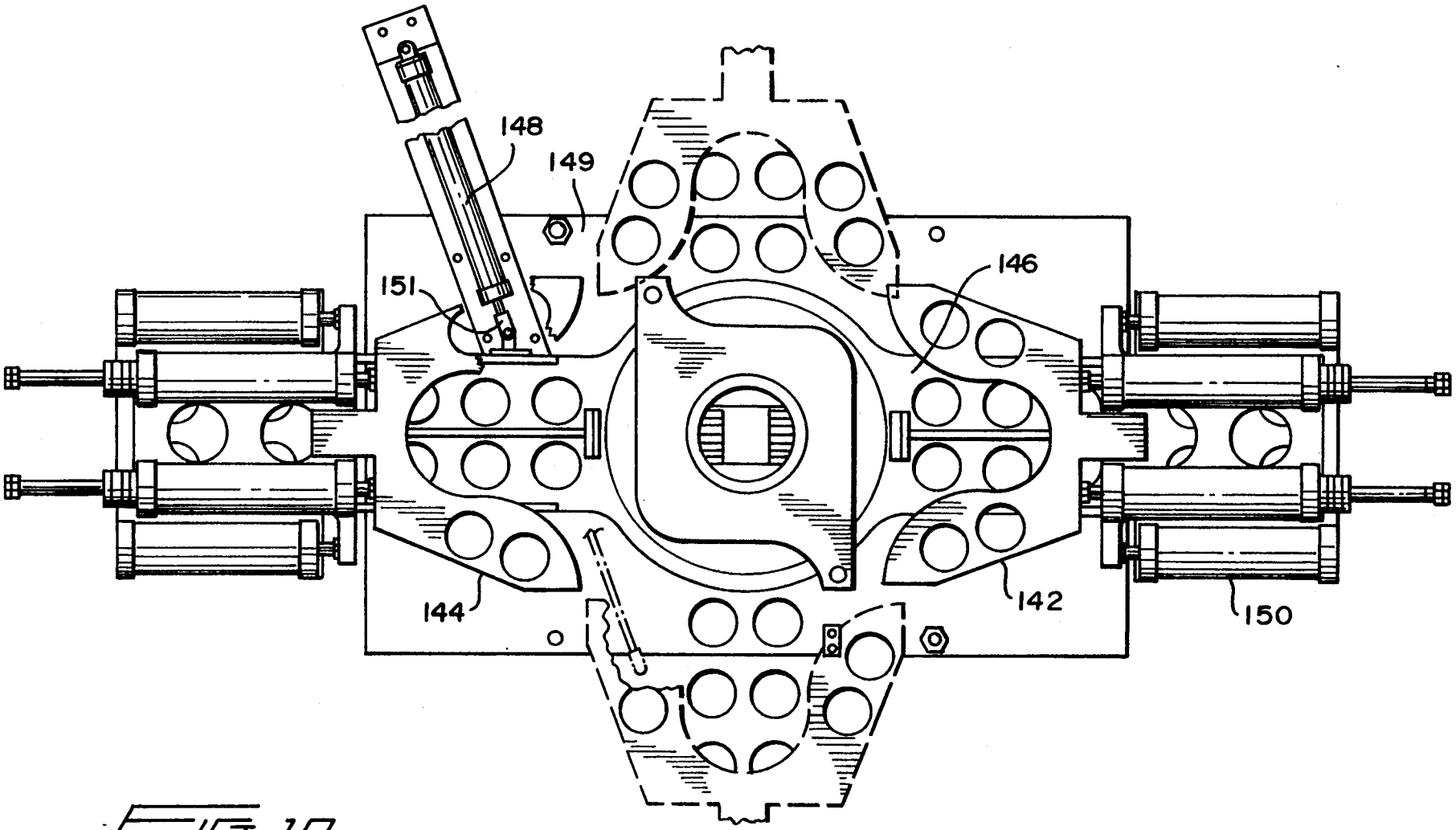
FIG. 10 is a view of the bottom of the take-up mechanism looking through section B—B of FIG. 9A.

Turning now to FIGS. 8–11, there is shown the braiding head 22 in greater detail. FIG. 8 is a perspective view of the braiding head 22 which is supported on the upper frame by cross members 20 and 21 shown in FIG. 1. The braiding head 22 is composed of the generally rectangular outer frame 100, an inner frame member 152, a rectangular base member 149 and four upright columns 102 supporting an upper plate 104 which carries the take-up mechanism discussed in detail below. As shown in FIG. 1, the fibers 32 are connected from the carrier assembly 194 shown in FIG. 6A to the braiding head 106 (FIG. 8). The braiding head is supported for vertical movement within the columns 102 by four ball screws 108. Where the ball screw 108 passes through the braiding head base 110, a ball nut of conventional design is installed.

Figure 11:
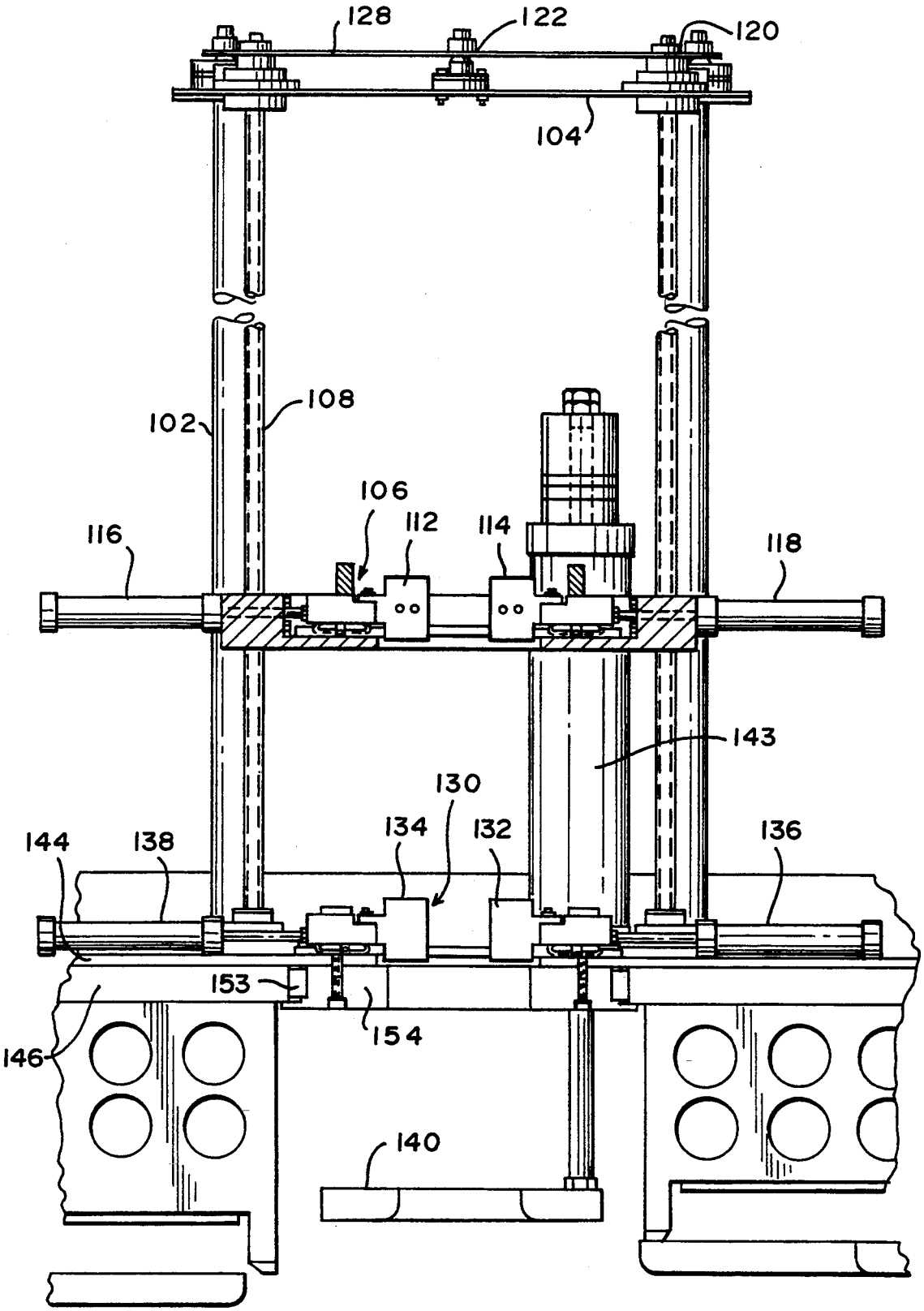
FIG. 11 is a section through line E—E of FIG. 9B.

The braiding head 106 has two jaws 112 and 114 shown in FIG. 11, mounted for linear movement transverse to the vertical axis of the head. These jaws are moved by linear actuators 116 and 118. These jaws serve to clamp the braided preform while the braiding is in process. On the upper plate 104 of the head, the four ball screws 108 are mounted for rotation about their axes. At their other end, they are rotationally attached to the base of the head. At the top end, they are provided with a sprocket 120. Also mounted on the upper plate 104 is a stepping motor 124 and speed reducer 125 (FIG. 8) having a sprocket (not shown). A driving chain 128 is driven by the speed reducer via the stepping motor and is connected to ball screw pulleys 120 and the idler pulleys 122 to drive the ball screws in response to output movement of the stepping motor. Thus, as the stepping motor is actuated, the ball screws 108 are turned and react with the ball nuts in the braiding head 106 to move the braiding head up or down. Below the braiding head 106 is a holding head 130. This holding head is fastened to the base 149. The holding head is provided with jaws 132 and 134 which are actuated by actuators 136 and 138 in the same manner as described in connection with jaws 112 and 114 in the braiding head.

Extending from the lower surface is a ring member 140 attached to the base of the braiding head 22 for vertical movement between the extended position shown and the retracted position abutting the pivot member 146. The ring 140 is moved vertically by actuators 141 and 143. The function of the ring will be described in connection with the operation of the device given below. Attached to the pivot member 146 are pair of semi circular devices 142, 144. These devices are attached to the pivot member for translational movement toward and away from the vertical axis of the braiding head. Eight actuators 150 are mounted in pairs to move the devices in and out of the braiding area. As shown in phantom lines in FIG. 10, these semi-circular devices may be rotated 90° by actuator 148 when the beating cable is to be raised in the other orthogonal direction. Actuator 148 is attached to the base member 149 and to the pivot member by a clevis 151. The pivot member 146 is supported for rotation about the vertical axis of the braiding head by bearing 153 by means of bearing mount 154, FIG. 11. The function of these devices will be described in connection with the description of the operation of the invention given below.

Figure 13A:
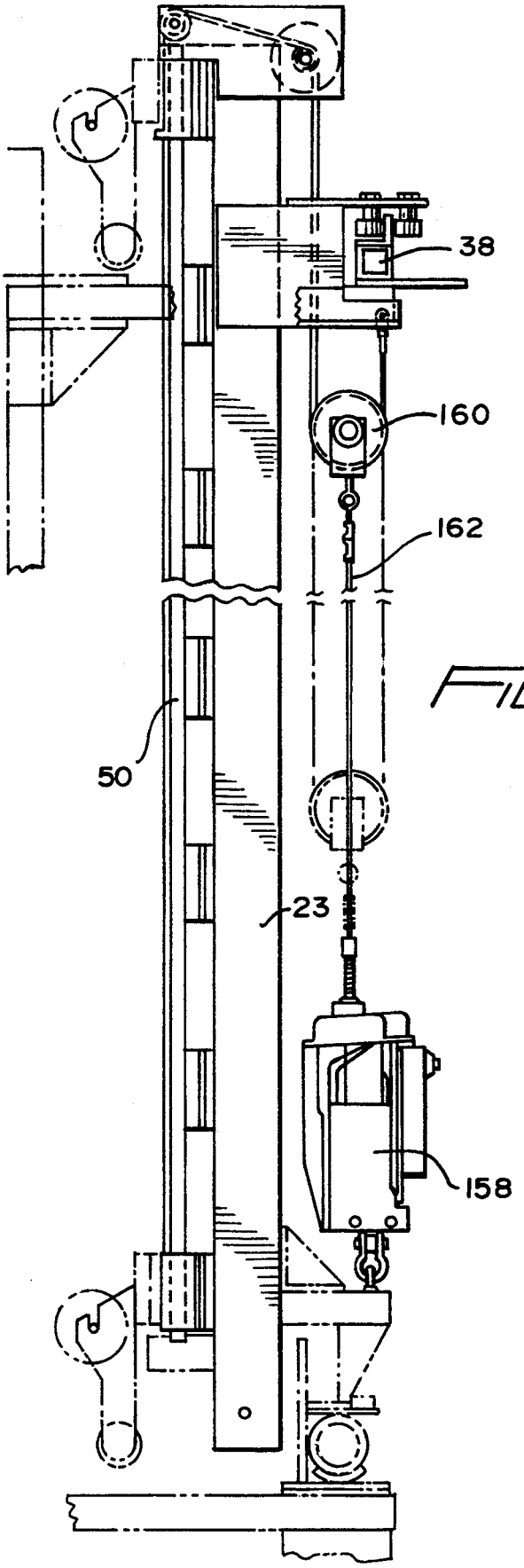
FIGS. 13A and 13B are two views of a typical beating station.
Figure 13B:
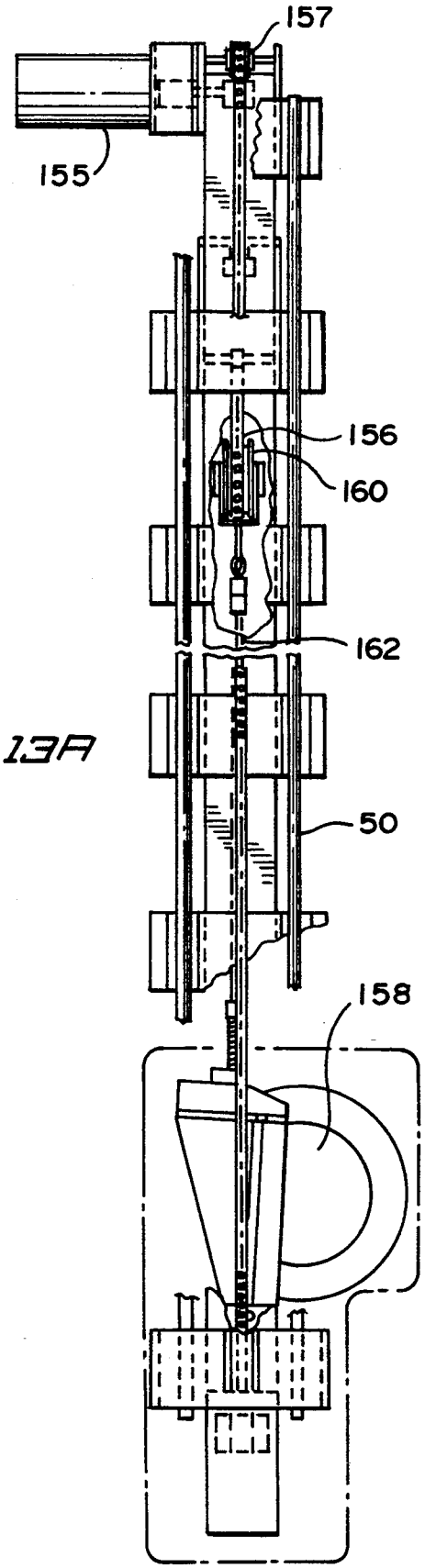

Referring now to FIGS. 12, 13 and 14, the mechanism for compacting or "beating" the braided preform is shown. As discussed in connection with FIG. 1, cable sending stations 24 and 27 are mounted on vertical bearing assemblies 50 and 54 for vertical movement along the vertical member. The vertical member 23 is mounted on bearing assemblies 41 and 44 for translation along one side of the frame. Movement of the member 23 along bearing assemblies 41 and 44 is achieved by a stepping motor 46 of any known type. FIG. 12 shows a perspective view of the cable sending assembly 48. The sender 48 is moved vertically along member 23 by means of a motor 155, having a pinon sprocket 157 to drive perforated tape 156, FIG. 13B. The weight of the assembly is balanced by a tool balancer 158 of any known design. Such balancers typically utilize a spring loaded pulley to assist vertical movement of a heavy tool. As shown in FIGS. 13A, 13B and 13C, the balancer is attached to idler pulley 160 by means of cable 162. In FIG. 12 the sender assembly is in the down position. As the sender is raised by the tape 156 a spring, (not shown) in the tool balancer assists in raising the sender assembly. A sender assembly 48 contains a beating cable 166 stored on cable reel 164. Cable 166 is releasably attached to the sending tape 168 which is contained on reel 170. Tape 168 is driven across the carrier plane in slots 68 or 90 in the track assembly by motor 172 driving pinon sprocket 174. Cable 166 is releasably attached to tape 168 by clip 176. At the end of cable 166 are two balls 178 and 180 for securing the cable to the receiving station as explained below.

Figure 14A:
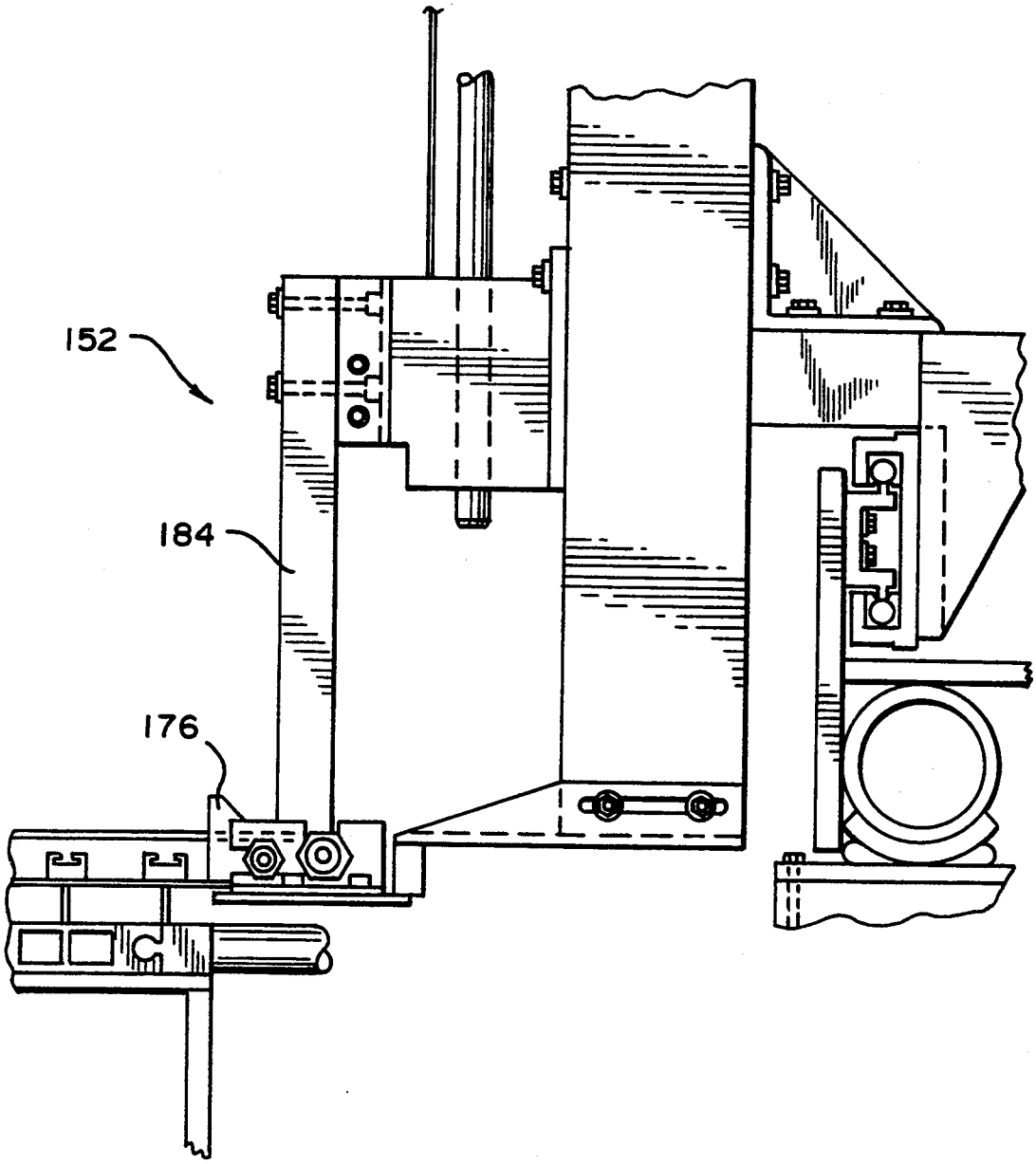
FIGS. 14A, 14B, 14C, and 14D are details of the receiving mechanism.
Figure 14C:
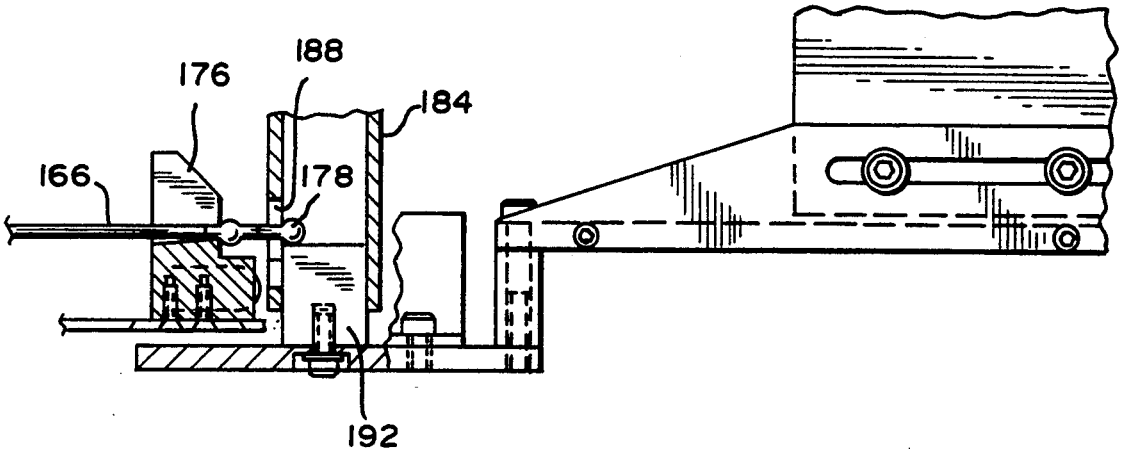
Figure 14B:
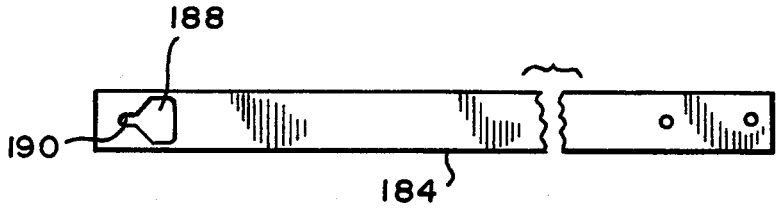
Figure 14D:
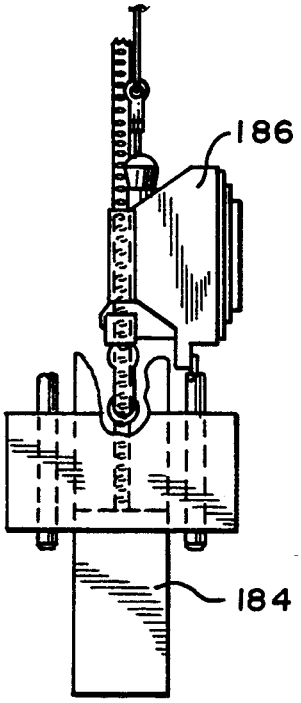

The receiving station assembly is shown in FIGS. 14A, 14B, 14C and 14D. The receiving stations 25 and 26 of FIG. 1 are mounted on a vertical member and moved vertically along the members in the same manner as described in connection with the sending stations above. As shown in FIG. 14D, a similar but smaller tool balancer 186 assists in raising the receiving assembly 52 since the receiving station weighs less than the sending station. As shown in FIGS. 14B and 14C, post 184 is provided with a cable receiving slot 188 at its lower end which tapered to a narrow slot shown at 190. In FIG. 14C, the receiving post 184 is shown in sectional view showing a cable 166 inserted in slot 190. Attached to the lower frame is plug member 192 which fits inside post 184. When the receiving post is in the lower position the cable ball 178 rests on plug 192.

OPERATION OF THE INVENTION

Figure 15:
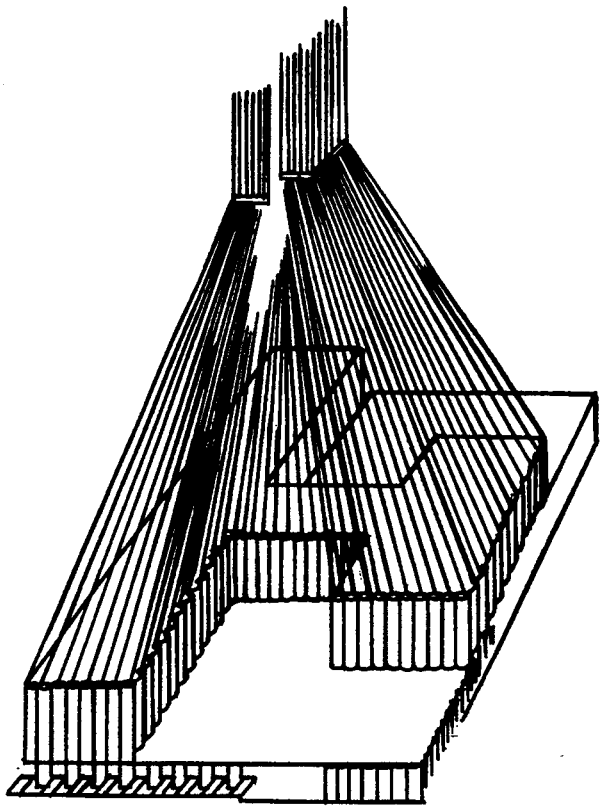
FIG. 15 is an isometric view of a braiding matrix.

The braiding apparatus of this invention operates in the following manner:

To begin the operation, the required number of bobbins 194 are loaded with fiber and attached to the appropriate carrier bases 80. The loading pattern on a carrier plane will depend upon the shape to be braided. For example, if the form is to be a modified H shape the reels would be loaded as shown in FIG. 15. The individual fiber strands are extended from the carrier plane to the braiding head 22 as shown generally in FIG. 1. Fibers are collected into a bundle and clamped by upper jaws 112 and 114 in the braiding head. All of the fibers are passed through ring 140 to maintain a maximum angle between the fiber and the vertical axis of the braiding head to less than approximately 22½ degrees. The two outside rows of track are dummy tracks which contain no carriers.

Figure 16:
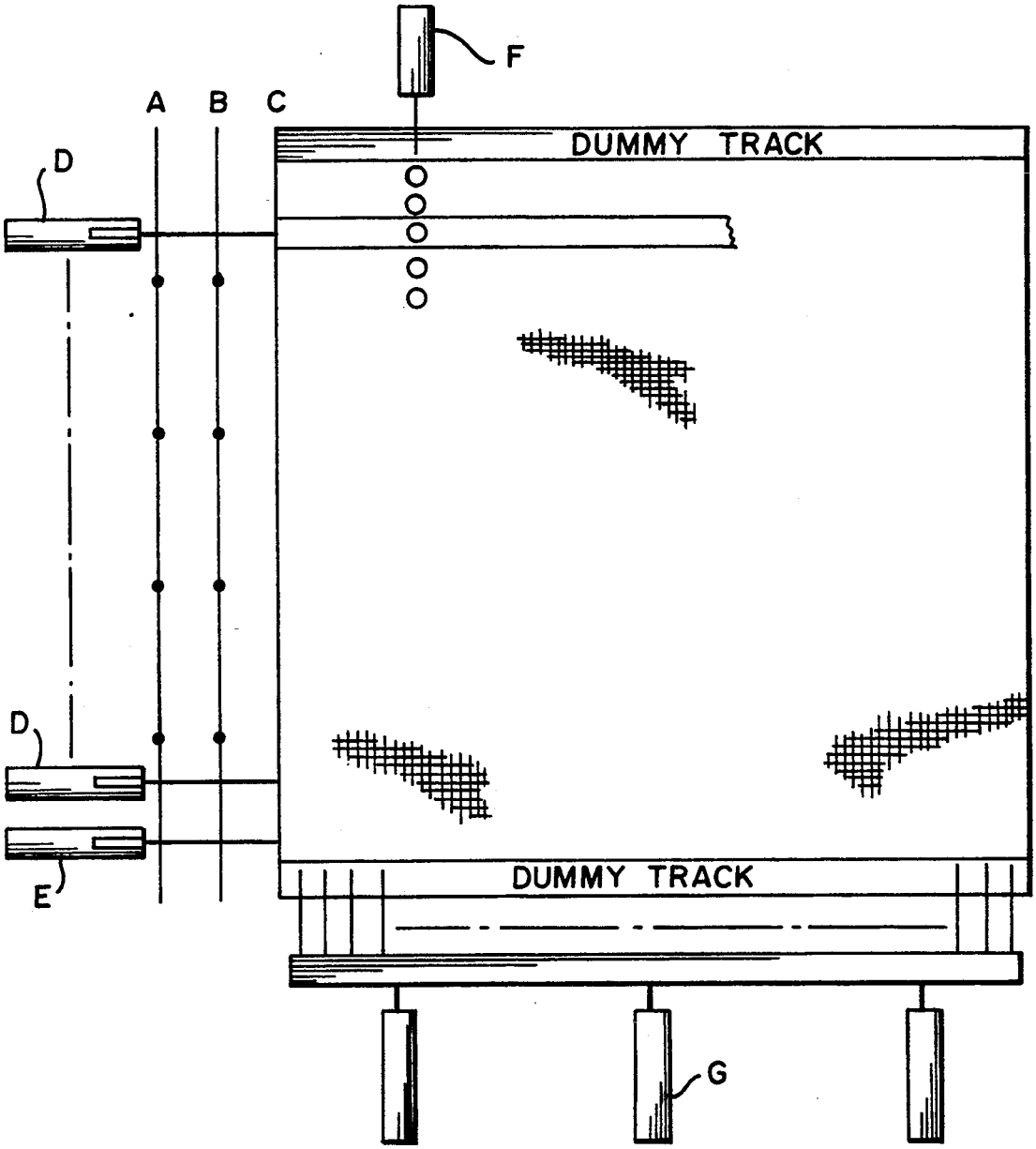
FIG. 16 is a schematic plan view of the lower frame.

The sequence of actuator operation is best understood in connection with FIG. 16 and with reference to Table 1. FIG. 16 is a schematic plan view of the lower frame of the apparatus showing the location of all of the actuators utilized in a braiding "shuffle". In FIG. 16 and table 1, each of the various actuators of the apparatus has been assigned a letter designation from A to G. The condition of each actuator is described in table 1 by an X if the actuator is energized to push or by an O if the actuator is energized to retract to its starting position.

Following table 1, at steps one, two and three, the actuators F, D, and E are energized to retract to the starting position. Actuator G is energized and retracted in steps 4 and 5 to insure that all of the carriers are in the correct starting position. The braiding process starts at step 6.

At step 6 all stop actuators are in their retracted positions. At step 7, all D actuators attached to tracks required to make a three step move are actuated. At step 8, two step track stop B is actuated. Step 9, all D actuators for tracks to move two steps are actuated. Step 10, one step track stop A is actuated. Step 11, all D actuators for one step track moves are actuated. At steps 12 and 13 the reset comb actuators are actuated and retracted to insure the proper starting position for the carriers. At step 14, the half step actuator E at the outside of the frame is actuated. At steps 15 and 16 the column actuators F for carriers to move three steps are actuated and retracted- At step 17 the half step actuator next inside the edge of the frame is actuated. At steps 18 and 19, column actuators for two step carrier moves are actuated and retracted. At step 20, the half step actuator next inside the edge of the frame is actuated, followed by steps 21 and 22 to again actuate and retract the column actuators F for carriers to move one step. To complete one "shuffle", all half step actuators E and track actuators D are retracted by steps 23 and 24. Steps 6–24 are then repeated to complete an entire "move".

At the completion of each move, the stepping motor 124 is actuated to turn the ball screws 108 a predetermined amount to raise the head 106 to take up the braided portion. After the braiding head has moved to its top-most position, the holding jaws 132 and 134 are actuated to hold the braided portion in place. Next, the braiding head jaws 112 and 114 are released and motor 124 is actuated to return the head to its original lower starting position. The braiding head jaws 112 and 114 are actuated to grasp the braided material and the holding jaws 132 and 134 are released.

TABLE I

| | ACTUATORS | | | | | | |
|---|---|---|---|---|---|---|---|
| STEP | A | B | C | D | E | F | G |
| 1. | | | | | | o | |
| 2. | | | | | o | | |
| 4. | | | | | | | x |
| 5. | | | | | | | o |
| 6. | | | x | | | | |
| 7. | | | | x | | | |
| 8. | | x | | | | | |
| 9. | | | | x | | | |
| 10. | x | | | | | | |
| 11. | | | | x | | | |
| 12. | | | | | | | x |
| 13. | | | | | | | o |
| 14. | | | | | x | | |
| 15. | | | | | | x | |
| 16. | | | | | | o | |
| 17. | | | | | x | | |
| 18. | | | | | | x | |
| 19. | | | | | | o | |
| 20. | | | | | x | | |
| 21. | | | | | | x | |
| 22. | | | | | | o | |
| 23. | | | | o | o | | |
| 24. | | | o | | | | |

Actuator Motion:
x = Push
o = Retract
Actuator Description:
A: One step track stop
B: Two step track stop
C: Three step track stop
D: Full track stroke
E: Half step track
F: Column actuators
G: Reset comb Just as in flat weaving, periodically the braided material must be compacted. The braid is compacted using the beating cable described above. To begin the beating sequence, the sending station is actuated. The tape 168 is inserted in a preselected row of carrier tracks into the slots 68 at the top of the carrier tracks. The tape is sufficiently stiff axially to be propelled across the carrier plane in the slot to the receiving station opposite. When the tape 168 carrying cable 166 reaches the receiving station, the cable is inserted into slot 188 in receiving post 184. Next, the elevating motors 155 for raising and lowering the sending and receiving stations are actuated. Simultaneously, motors 46 which drive the vertical post of the sending and receiving stations laterally are also actuated. The controller function for the apparatus controls the hoisting and translating motors such that the path of cable 166 follows the angle of the adjacent fiber. As the beating cable reaches ring member 140, it passes through the diametral slot and the pair of semi circular devices 142 and 144 are actuated to form a circle around the fiber bundle. When the semi circular devices are in place they maintain the 22½ degree angle as the ring 140 is raised by means of cylinders 142 and 144 to abut the pivot member 146 of the braiding head 22. The sending and receiving stations are then returned to their lower starting positions. As the receiving post 184 reaches the plug 192, the cable ball 178 is raised out of the slot portion 190 and then to the enlarged portion 188 and is engaged into clip 176. The tape is then retracted back to the tape reel 170 on the sending head carrying the cable to its reel. To beat across the other direction of the carrier tracks, the tape is inserted into slot 90 formed by the adjacent carrier tracks and bases. The beating process is the same in this direction as was described above.

Thus there is provided herein a fully automated three dimensional braiding mechanism for automatically producing braided preforms of great length with a minimum of manual operations. The mechanism described provides for automatic compacting of the braided form and automated take-up of the completed product. Various shapes may be formed according to the particular braiding process selected.

What is claimed is:

1. Apparatus for braiding of a three dimensional form comprising:

an upper frame;

a lower frame;

a braiding head supported on said upper frame;

a plurality of tracks forming track rows slidably supported on said lower frame, said tracks having transverse slots forming transverse columns across said tracks;

a plurality of carrier members mounted in the slots in said track members for movement therewith and moveable along said transverse columns;

fiber holding means mounted on said carriers;

a supply of fiber mounted on each of said fiber holding means, each of said fibers being attached to said braiding head;

means for moving said tracks in accordance with a predetermined braiding schedule, said means comprising a first plurality of actuators mounted along one side of said lower frame, each of said actuators being attached to one of said tracks for moving said track across the frame and a second plurality of actuators mounted on another side of said lower frame, each of said second plurality of actuators being aligned with one of said transverse columns for moving said carriers along the transverse slots;

means for limiting the travel of said first plurality of actuators to defined steps of at least two different lengths;

means for limiting the travel of said second plurality of actuators to defined steps of at least two different lengths;

means for moving said carrier members along said transverse columns in accordance with a predetermined braiding schedule whereby movement of said tracks and said carrier members generates a braided form at the braiding head;

means for compacting the braided form at the braiding head;

a plurality of stop members;

actuator means selectively actuable to interfere with the movement of the first plurality of actuators after movement of predetermined defined steps;

means for selectively blocking the movement of said carriers along said transverse columns at selected predetermined points in said column defining predetermined steps for said carriers;

means for moving some of said first plurality of actuators one half of a defined step whereby the tracks connected to said actuators block the transverse columns at the intersection with said track said means comprising a dual actuator having first and second moveable portions, said first portion having a working stroke the length of the predetermined steps and the second portion having a working stroke of a length equal to one half of one defined step.

2. Apparatus for braiding of a three dimensional form comprising:

an upper frame;

a lower frame;

a braiding head supported on said upper frame;

a plurality of tracks forming track rows slideably supported on said lower frame, said tracks having transverse slots forming transverse columns across said tracks;

a plurality of carrier members mounted in the slots in said track members for movement therewith and moveable along said transverse columns;

fiber holding means mounted on said carriers;

a supply of fiber mounted on each of said fiber holding means, each of said fibers being attached to said braiding head;

means for moving said tracks in accordance with a predetermined braiding schedule;

means for moving said carrier members along said transverse columns in accordance with a predetermined braiding schedule whereby movement of said tracks and carrier members generates a braided form at the braiding head; and means for compacting the braided form at the braiding head, said compacting means comprising means for extending a compacting member across the lower frame and means for raising the compacting member to the braiding head for compacting the braided form.

3. The apparatus according to claim 2 and further comprising first and second compacting means, said first and second compacting means extending in orthogonal relationship across the lower frame.

4. The apparatus according to claim 3 wherein each of said compacting means comprises:

a cable contained on a reel and attached to one side of said lower frame;

means to transport each of said cables across the lower frame;

means for raising said cables along a path parallel to the angle of the fiber with the vertical axis of the apparatus.

5. The apparatus according to claim 4 wherein the means for transporting the cable across the lower frame comprises:

cable transport means for attached to one side of said lower frame for sending said cable across said lower frame;

cable sending means attached to said cable transport means;

cable receiving means attached to the side of the lower frame opposite the cable sending means for receiving one end of the cable from the cable transport means;

means for simultaneously raising the cable sending and receiving means and the cable along a path parallel to the fiber between the lower frame and the braiding head.

6. The apparatus according to claim 5 wherein said cable transport means comprises:

a perforated tape contained on a reel in said sending means and attached to one end of said cable;

tape drive means attached to said sending means and having a toothed wheel, the teeth of said toothed wheel being engaged in the perforations of said perforated taped, channel means extending across said lower frame, said channel means formed to accept the tape and restrain its vertical movement while allowing transport across the lower frame.

7. The apparatus according to claim 6 and further comprising:

a ball attached to the free end of each of said cables;

cable receiving means comprising a slotted member, the slot in said slotted member being narrower than the diameter of said ball and wider than the diameter of said cable; and ball removal means attached to said lower frame for forcing the ball from the slot in said cable receiving means at the end of a compaction cycle.

8. The apparatus according to claim 5 wherein the means for simultaneously raising said sending and receiving means comprises:

vertical track means attached at one end to said lower frame and at the other end to said upper frame, one of said tracks being mounted at each side of said frame;

suspension means attached to each of said receiving means and said sending means at one end and to the upper end of each of said vertical tracks for suspending the sending and receiving means for movement along said vertical tracks;

hoisting means attached to the upper ends of each of said vertical tracks and to one end of said suspension means for raising and lowering said sending and receiving means.

9. The apparatus according to claim 8 and further comprising:

horizontal track means extending along each side of said lower frame and upper frames;

means for attaching the ends of said vertical tracks to an upper and lower pair of said horizontal tracks for movement along said horizontal tracks;

means for moving said vertical tracks along said horizontal tracks; and control means for controlling said hoisting means and said means for moving said vertical tracks simultaneously for moving said sending and receiving means along a path parallel to the angle of said fiber with the vertical axis of the apparatus.

10. The apparatus according to claim 9 and further comprising a balancer attached to each of said senders and receivers to balance the weight of each sender and receiver to assist said hoisting means to raise and lower said senders and receivers.

11. Apparatus for automatically braiding a three dimensional form comprising:

an upper frame;

a lower frame;

a braiding head supported on said upper frame for vertical movement, the braiding head forming a braiding plane at its lower surface;

fiber clamping means attached to said braiding head for holding the fibers at the braiding plane;

a plurality of tracks forming parallel track rows extending parallel to one side of said frame, each of said tracks containing a plurality of pockets, said pockets of adjoining track rows forming a plurality of transverse columns;

a plurality of carriers slidably mounted in said pockets and forming a plurality of carrier columns transverse to said tracks said carriers forming a carrier plane;

fiber holding means mounted on each of said carriers;

a fiber supply contained on each of said fiber holding means, each of said fibers extending from the carrier plane to the fiber clamping means at the braiding plane;

a plurality of first actuator means attached to said each of said tracks and to one side of said lower frame for moving each of said tracks along the carrier plane;

a plurality of second actuator means attached to one side of said lower frame adjacent the side of said lower frame containing said first plurality of actuators, each of said second plurality of actuators aligned with one of said columns of carriers for moving said column of carriers;

means for stopping the movement of said tracks at predetermined discrete steps;

means for stopping the movement of said carrier columns at predetermined steps;

means for returning said tracks to their original starting position when all of said tracks and carrier columns have been moved their predetermined discrete steps;

means for returning said carrier columns to their original starting positions when all of said tracks and carrier columns have been moved their predetermined discreet steps;

means for moving said braiding head up a predetermined amount after each time the tracks and carrier columns are returned to their original positions; and compacting means for compacting the braided form at the braiding plane.

12. The apparatus according to claim 11 wherein the means for stopping the movement comprises:

a shoulder mounted on the moveable portion of each of said first actuator means;

a first stop bar arranged under the moveable portions of said first actuator means, said first stop bar interfering with the motion of the moveable portion of said first actuator means by contacting the shoulder of said actuator after said actuator has moved one discrete step when said stop bar is in a raised position;

actuator means for raising said first stop bar to a position of interference with said first actuator means;

a second stop bar arranged under the moveable portions of said first actuator means, said second stop bar interfering with the motion of the moveable portion of said first actuator means by contacting the shoulder of said actuator after the actuator has moved two discrete steps when the second stop bar is in the raised position; and means for raising said second stop bar to a position of interference with said first actuator means.

13. The apparatus according to claim 12 wherein the means for stopping the movement of said carrier columns comprises:

auxiliary actuators attached to selected ones of said first actuator means for moving selected outside rows of tracks an amount equal to one half of a discrete step thereby blocking the transverse columns at the track moved one half a discrete step.

14. The apparatus according to claim 13 wherein said compacting means comprises:

two pairs of compacting stations, one of each of said pairs being places on opposite sides of said frame, each of said pairs consisting of a sending station and a receiving station on opposite sides of said frame;

a compacting cable attached to each of said sending stations;

a cable reel for holding the supply of cable;

cable transport means attached to said sending stations and releasably attached to the free end of said cable;

means for extending said cable and cable transport means from the sending station to the opposite receiving station;

means for attaching the free end of said cable to said receiving station;

means for returning said cable transport means to said sending station;

means for raising said sending and receiving stations and said cable simultaneously to the braiding plane whereby said cable compacts the braided form at the braiding plane;

means for returning said sending and receiving stations and said cable to their starting positions;

means for re-attaching said cable to said cable transport means and returning said cable and said cable transport means to the sending station.

15. The apparatus according to claim 14 wherein said compacting means further comprises:

horizontal track means extending around the edges of said lower and upper frames, a plurality of vertical track means attached at their ends to said upper and lower horizontal tracks for movement along said horizontal track for transporting said sending and receiving stations to the braiding plane, said vertical track means being mounted in opposite pairs across said frame;

means for suspending each sending and receiving stations on an individual vertical track;

hoisting means attached to the top of each vertical track for raising said sending and receiving stations along said vertical tracks by pulling said suspension means toward the upper frame.

16. The apparatus according to claim 15 wherein the means for suspending the compacting stations comprises:

a perforated tape contained on a reel at the top of the each vertical track, said tape being connected to its respective compacting station;

tape drive means attached to the top of each vertical track for moving said tape along the vertical track, said drive means comprising a toothed wheel whose individual teeth engaged in the perforations of said tape and acting to move the tape along the vertical track.

17. The apparatus according to claim 16 wherein said cable transport means comprises:

a length of perforated tape contained on a reel at each of said sending stations;

tape drive means attached to said reel for driving said tape, said tape drive means having a toothed wheel engaged in the perforations of said tape;

tape slots formed by said track rows and extending across said carrier plane, one slot being formed for each row and column, said tape being inserted in said slots at the sending station and extended to the receiving station by said tape drive means.

18. The apparatus according to claim 11 wherein the means for moving said braiding head comprises:

first clamp means attached to said braiding head for clamping the mass of fibers from the carrier plane;

means for selectively clamping and releasing said first clamp means;

second clamp means attached to said upper frame below said first clamp means for clamping the mass of fibers from the carrier frame;

means for selectively clamping and releasing said second clamp means whereby when said braiding head reaches the limit of its travel, the second clamp means is actuated, the first clamp means is released, the braiding head moved to its original position, reclamped and the next take-up cycle begun.

19. Apparatus for braiding of a three dimensional form comprising:

an upper frame;

a lower frame;

a braiding head supported on said upper frame;

a plurality of tracks forming track rows slideably supported on said lower frame, said tracks having transverse slots forming transverse columns across said tracks;

a plurality of carrier members mounted in the slots in said track members for movement therewith and moveable along said transverse columns; fiber holding means mounted on said carriers;

a supply of fiber mounted on each of said fiber holding means, each of said fibers being attached to said braiding head;

means for moving said tracks in accordance with a predetermined braiding schedule, means for moving said carrier members along said transverse columns in accordance with a predetermined braiding schedule whereby movement of said tracks and carrier members generates a braided form at the braiding head;

means for compacting the braided form at the braiding head;

a ring member suspended between the lower frame member and the braiding head, through which the fibers pass between the carrier and the braiding head, the angle between the fiber and the vertical axis above the ring being less than 22.5 degrees;

actuator means for raising said ring member to a position abutting the bottom of said braiding head;

secondary means for limiting the angle of the fiber entering the braiding head when said ring member is in the raised position, said secondary means comprising;

first and second arcuate members slideably mounted on the bottom of said braiding head, the open side of said arcuate members arranged to face each other on opposite sides of the vertical axis of the braiding head;

actuator means for sliding said arcuate members toward each other thereby forming a partial circle around the fibers attached to the braiding head; and means for selectively rotating said secondary means 90° from their original position in the plane of the upper frame.

* * * * *